US006758769B2

(12) United States Patent
Nelson

(10) Patent No.: US 6,758,769 B2
(45) Date of Patent: Jul. 6, 2004

(54) ELECTRONIC SOUND EFFECT ASSEMBLY FOR USE ON A SPORT'S GOAL NET

(76) Inventor: Webb T. Nelson, 19180 144th Ave. NE., Woodinville, WA (US) 98072

( * ) Notice: Subject to any disclaimer, the term of this patent is extended or adjusted under 35 U.S.C. 154(b) by 21 days.

(21) Appl. No.: 10/104,258

(22) Filed: Mar. 25, 2002

(65) Prior Publication Data

US 2003/0181268 A1 Sep. 25, 2003

(51) Int. Cl.[7] ..... A63B 63/08
(52) U.S. Cl. ..... 473/480
(58) Field of Search ..... 473/480, 479; 273/402, 371; 340/384.4, 686, 323

(56) References Cited

U.S. PATENT DOCUMENTS 4,335,377 A * 6/1982 Bostic ..... 340/573.1
5,039,977 A * 8/1991 Mele et al. ..... 340/323 R
5,064,195 A 11/1991 McMahan et al.
5,326,094 A * 7/1994 Quinn ..... 273/371
5,762,569 A * 6/1998 Hale ..... 473/480
5,813,928 A * 9/1998 Hsieh ..... 473/480

* cited by examiner

*Primary Examiner*—Stephen P. Garbe
*Assistant Examiner*—M. Chambers
(74) *Attorney, Agent, or Firm*—LaMorte & Associates

(57) ABSTRACT

A sound effect assembly that attaches to the net of a goal. The sound effect device contains a sensor that either detects the motion of the net or the passing of the ball or puck. When the sound effect assembly is activated, the sound effect device generates audible sounds, preferably that of a cheering crowd. Accordingly, each time a goal is made, the sound effect device produces the sounds of a cheering crowd. The sound effect device is produced in a very small housing that hooks onto the net of a goal. In this manner, the attachment of the sound effect device to the net does not adversely effect the characteristics of the net or the odds of making a goal by a person playing the sport.

7 Claims, 3 Drawing Sheets

ELECTRONIC SOUND EFFECT ASSEMBLY FOR USE ON A SPORT'S GOAL NET

BACKGROUND OF THE INVENTION

1. Field of the Invention

The present invention relates to electronic sound effect assemblies that electronically produce music, words or other sounds when activated. More particularly, the present invention relates to sound effect assemblies that are activated when a score occurs during a sporting event.

2. Prior Art Statement

Many sports contain goals through which a ball or puck must enter in order to obtain points. In many of these sports, the goal is reinforced with a net to catch or slow the ball or puck, as the ball or puck passes into the goal. Examples of sports that have goals with nets include, soccer, lacrosse, hockey, field hockey, water polo and basketball.

Basketball is a sport that is popular throughout the world. In the game of basketball, points are scored by throwing a basketball through an elevated hoop. A net is suspended from the hoop to slow the basketball as it passes through the hoop and to make a scoring shot more visually obvious. Over the years numerous electronic devices have been added to basketballs and basketball hoops to add novelty to the game and to make the game more interesting to play, especially with children.

Many of the electronic devices that have been developed are used to keep score. In these devices, a mechanism is provided that changes a score on a scoreboard each time a basketball is detected passing through the hoop. Many of these devices also contain light or buzzers that are also activated when the basketball passes through the hoop. Such prior art scoring devices are exemplified by U.S. Pat. No. 2,534,067 to Rubin, entitled Adjustable Basketball Hoop Mounting and U.S. Pat. No. 2,192,430, to Branner, entitled Register. Such prior art devices are complex assemblies that can only be used with custom built hoops. These devices cannot be retroactively added to existing basketball hoops.

There also exist many sound effect devices that are built into novelty basketball hoops, such as basketball hoops that are placed over office trashcans. These sound effect devices produce noise each time any item is thrown through the hoop, thereby adding to the novelty of the device. Such prior art devices are exemplified by U.S. Pat. No. 5,064,185 to McMahan, entitled Novelty Basketball Goal Producing Sound Effects On Made Shot; and U.S. Pat. No. 5,762,569 to Hale, entitled Device For Converting A Container Into A Figure To Simulate An Interactive Game. However, such prior art devices are assemblies that can only be used with custom built novelty hoops. These devices cannot be retroactively added to existing regulation basketball hoops.

In the prior art there is at least one electronic device that can be retroactively applied to a regulation basketball hoop. Such a device is disclosed in U.S. Pat. No. 5,813,928 to Hsieh, entitled Ball Basket. In the Hsieh patent, a device is shown that produces audio-photo effects when a ball passes through the net suspended below the hoop. The device contains a string that must be threaded through the web of the net below the hoop. The string is strung into a circle that has the same diameter as the basketball. Consequently, when a basketball passes through the hoop, the circle of string is stretched and activates the electronic device.

The disadvantages of the device described in the Hsieh patent are numerous. First, it takes a good deal of effort to weave the string of the Hsieh device through the weave of a basketball net that is suspended ten feet above the ground. Furthermore, the presence of the string in the net of the hoop effects the characteristics of the net. The presence of the circle of string on the net increases the tautness of the net immediately below the hoop. The net may then act as a trampoline and bounce some shots out of the basket that normally would fall through the basket.

A need therefore exists for a sound effect device that can be easily added to or removed from a regulation basketball hoop that is activated each time a basketball passes through that hoop. A need also exists for a sound effect device that can be added to a regulation basketball hoop that does not adversely effect the physical characteristics of either the basketball hoop or the net suspended under the basketball hoop. These needs are met by the present invention as described and claimed below.

SUMMARY OF THE INVENTION

The present invention is a sound effect assembly that attaches to the net of a goal. When a goal is made, the ball or puck used to make the goal jostles the net behind or below the goal. The sound effect device contains a sensor that either detects the motion of the net or the passing of the ball/puck. When the sound effect assembly is activated, the sound effect device generates audible sounds, preferably that of a cheering crowd. The sound effects may or may not also be accompanied by flashing lights. Accordingly, each time a goal is made, the sound effect device produces the sounds of a cheering crowd.

The sound effect device is produced in a very small housing that hooks onto the net of a goal. In this manner, the attachment of the sound effect device to the net does not adversely effect the characteristics of the net or the odds of making a goal by a person playing the sport.

BRIEF DESCRIPTION OF THE DRAWINGS

For a better understanding of the present invention, reference is made to the following descriptions of exemplary embodiments thereof, considered in conjunction with the accompanying drawings, in which.

DETAILED DESCRIPTION OF THE DRAWINGS

Although the present invention sound effect device can be attached to any goal netting used in sports, such as a hockey net or a soccer net, the present invention sound effect device is especially well suited for use on a basketball hoop net. Accordingly, by way of example, the present invention sound effect device will be described in use on a basketball net in order to set forth the best mode contemplated for the invention.

Figure 1:
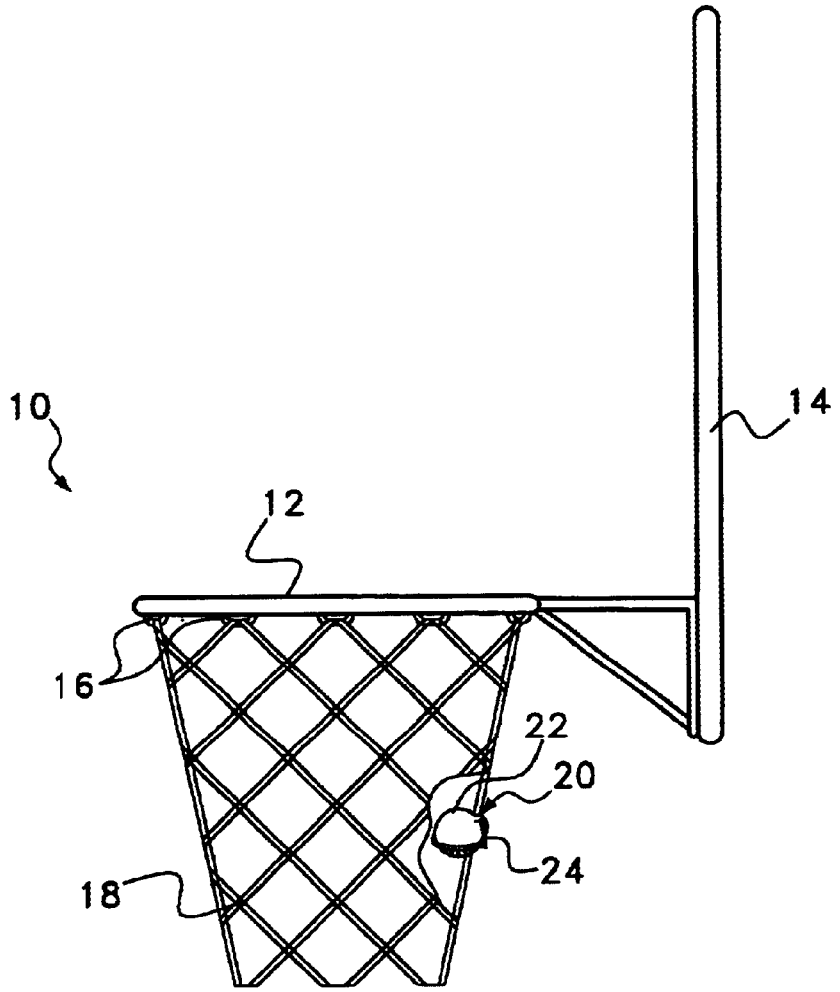
FIG. 1 is a side view of a basketball with a net on which one exemplary embodiment of the present invention sound effect device is attached.

Referring to FIG. 1, there is shown a basketball hoop and net assembly 10. The hoop and net assembly 10 consists of a metal basketball hoop 12 that is mounted to a backboard 14. Under the rim of the basketball hoop 12 are hooks 16. A net 18 is suspended from the hooks 16 under the hoop 12, as is traditional in the game of basketball. The net 18 is traditionally made of cording. However, metal chain nets can also be used.

The present invention is a sound effect device 20 that attaches to the net 18. The sound effect device 20 includes a housing 22. A hook 24 extends from the housing 22. The hook 24 attaches to a strand of the net 18, thereby engaging the net 18 and mechanically attaching the housing 22 to the net 18. The housing 22 of the sound effect device 20 has a size preferably smaller than two cubic inches. However, a size of about one cubic inch is preferred. The sound effect device 20 also has a small mass and is preferably less than two ounces in weight. At this size and weight, the present invention sound effect device 20 presents no adverse effects on the net 18 or the basketball hoop 12 that can in any manner effect the performance of the hoop and net assembly 10.

The sound effect device 20 is attached to the basketball net 18 at least six inches below the hoop 12. In this manner, the sound effect device 20 will experience significant movement each time a basketball passes through the hoop 12.

The sound effect device 20 produces sound effects when the net 18 is jostled by a basketball passing through the net 18. The sound effects can be music, a buzzer, synthesized voice phrases or the like. Preferably, the sound effect device 20 produces the sound of adulation from a large crowd. In this manner, each time a player makes a basket, the sound effect device 20 will produce the sounds of a cheering crowd.

Figure 2:
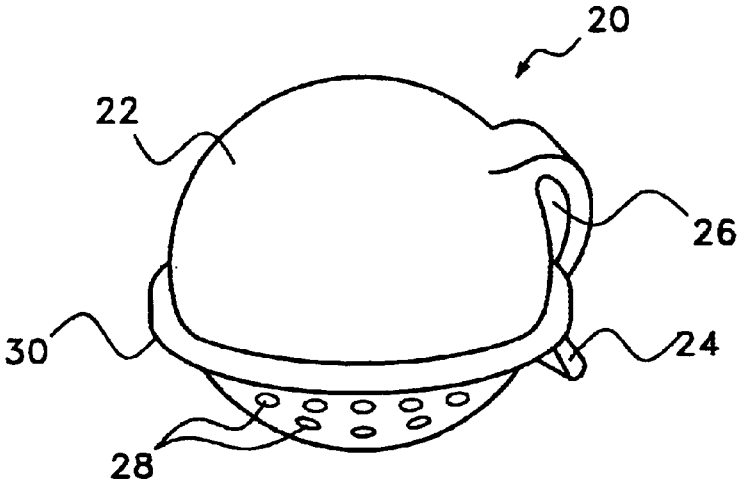
FIG. 2 is an enlarged view of the exemplary embodiment of the sound effect device shown in FIG. 1.

Referring to FIG. 2, it can be seen that the sound effect device 20 has a hook 24 that extends from the housing 22 of the device 20. The hook 24 is configured to define an open area 26 at the top of the hook 24. This open area 26 has a diameter of between ⅛ inch and ¼ inch. Below the open area 26, the hook 24 either abuts against the housing 22 or comes very close to the housing 22. In order to advance a segment of netting into the open area 26 of the hook 24, the hook 24 must be temporarily deformed away from the housing 22. In this manner, once a segment of net is advanced into the open area 26 of the hook 24, that segment of net is trapped between the hook 24 and the housing 22. Accordingly, the sound effect device 20 cannot be inadvertently detached from the segment of net once set in place.

Speaker ports 28 are disposed on the bottom of the housing 22. Behind the speaker ports 28 is either a speaker or a piezoelectric buzzer that produces sound. Accordingly, sound is transmitted out of the housing 22 through the speaker ports 28. Positioning the speaker ports 28 on the bottom of the housing 22 serves two purposes. First, it directs the sound effects downwardly. This is beneficial, seeing that the sound effect device 20 is attached to a basketball net that hangs ten feet in the air. The second purpose for positioning the speaker ports on the bottom of the housing 22 is that it prevents rain, dust or other debris from directly falling into the speaker ports 28 and entering the housing 22. A drip ridge 30 can be optionally disposed on the exterior of the housing 22 surrounding the speaker ports 28. The drip ridge 30 prevents water from adhering to the exterior of the housing 22 and collecting at the bottom of the housing 22 where the speaker ports 28 are present. In this manner, the present invention sound effect device 20 can be used on any indoor or outdoor sports net, wherein the operation of the sound effect device 20 should not be effected by weather.

Figure 3:
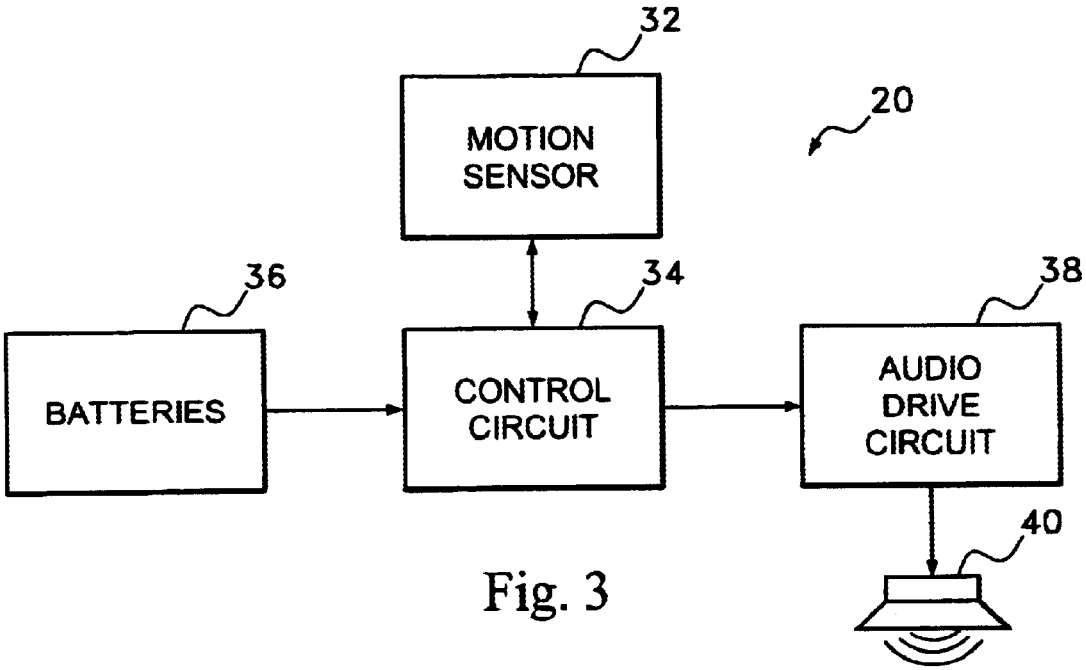
FIG. 3 is a schematic diagram illustrating the electronic components of an exemplary embodiment of the present invention sound effect device.

The sound effect device 20 is activated when a ball contacts the net onto which the sound effect device 20 is attached. The activation of the sound effect device 20 by a ball can be done in different ways. Referring now to FIG. 3, it can be seen that in an exemplary embodiment of the present invention, the sound effect device 20 contains a motion sensor 32. The motion sensor 32 can be an accelerometer, a tilt switch or any other electronic device that closes a circuit or produces a signal when accelerated with a predetermined threshold force. The motion sensor 32 is coupled to a control circuit 34, as is a battery 36. When a signal is received from the motion sensor 32 indicating that the sound effect device 20 has been moved with a predetermined force, the control circuit 34 powers an audio drive circuit 38 with the battery 36 for a predetermined period of time that is between 15 seconds and two minutes.

When the audio drive circuit 38 is powered, the audio drive circuit 38 drives a speaker 40, thereby creating a synthesized voice, music and/or the sounds of a cheering crowd. Once the predetermined period of time ends, the control circuit 34 shuts off the audio drive circuit 38 and the sound effects stop.

Figure 4:
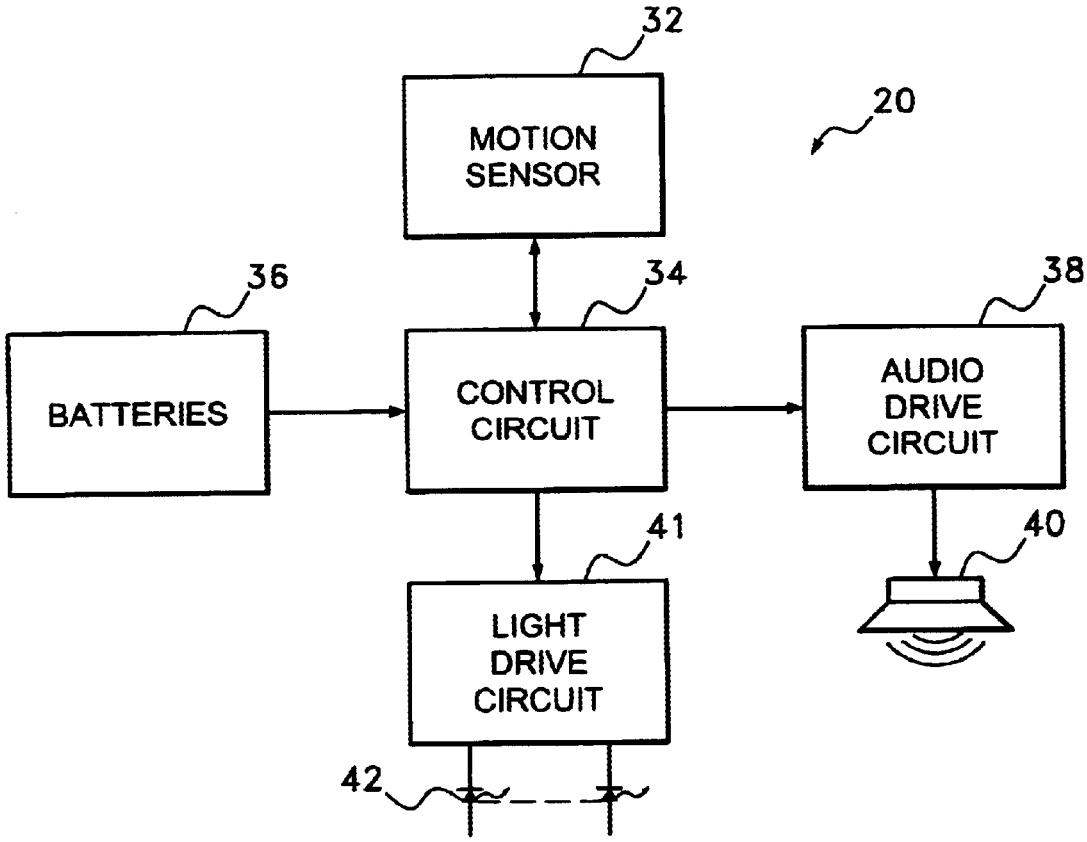
FIG. 4 is a schematic diagram illustrating the electronic components of an alternate exemplary embodiment of the present invention sound effect device.

Referring now to FIG. 4, an alternate embodiment of the present invention is shown. In this embodiment, the device 41 produces both light and sound when activated. Like the previous embodiment, the device 41 contains a motion sensor 32. The motion sensor 32 can be an accelerometer, a tilt switch or any other electronic device that closes a circuit or produces a signal when accelerated with a predetermined threshold force. The motion sensor 32 is coupled to a control circuit 34, as is a battery 36. When a signal is received from the motion sensor 32 indicating that the sound effect device 20 has been moved with a predetermined force, the control circuit 34 powers both an audio drive circuit 38 and a light driver circuit 42 with the battery 36 for a predetermined period of time. That predetermined period of time is preferably between 15 seconds and two minutes.

When the audio drive circuit 38 is powered, the audio drive circuit 38 drives a speaker 40, thereby creating a synthesized voice, music and/or the sounds of a cheering crowd. Once the predetermined period of time ends, the control circuit 34 shuts off the audio drive circuit 38 and the sound effects stop. Similarly, when the light drive circuit 42 is powered, the light drive circuit 42 drives at least one light emitting diode (LED) 44. The LEDs 44 light in some flashing pattern controlled by the light drive circuit.

Figure 5:
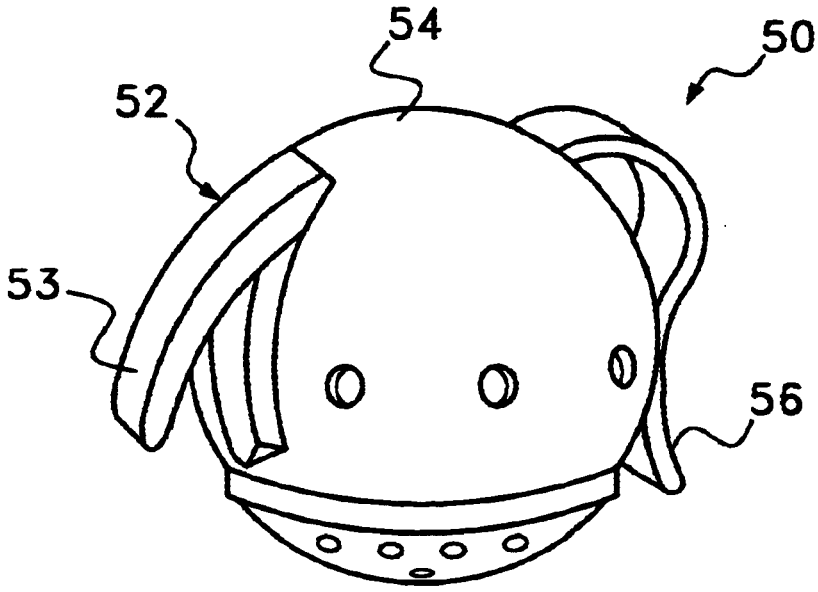
FIG. 5 is a perspective view of the alternate embodiment of the present invention sound effect device.

Referring now to FIG. 5, another embodiment of the present invention sound effect device 50 is shown. In this embodiment, a mechanical switch 52 is present on the exterior of the housing 54. The actuation arm 53 for the switch 52 extends from the housing 54 on the side opposite the hook 56. Accordingly, when the hook 56 engages the net of a basketball hoop, the actuation arm 53 of the switch 52 faces inward into the center of the net. As such, when a basketball falls through the net, the ball contacts the actuation arm 53 of the switch. The switch 52 takes the place of the motion detector previously described and actuates the internal circuitry that produces the sound effects and lights the LEDs.

The embodiment of the present invention having a motion detector is best when used on large nets, such as a hockey goal net or a soccer goal net. On such large nets, the odds of the sound effect device being directly contacted by a goal are small. Yet, the movement of the net, regardless of where the net is struck, will trigger the device. The embodiment of the sound effect device 50 with a direct mechanical activation switch 52 is useful in confined goals, such as basketball nets and billiard pockets where a passing ball must contact the sound effect device 50.

It will be understood that all of the embodiments of the present invention illustrated and described are merely exemplary and that the present invention can be practiced in a variety of different ways other than what is shown. For example, the shape of a housing can be changed to the whims of the manufacturer. A housing that looks like a basketball can be sold for use on a basketball net. A housing that looks like a hockey puck can be sold for use on a hockey net. All such modifications and alternate embodiments are intended to be covered by the scope of the claims presented below.

What is claimed is:

1. A method of providing sound effects to a sport that uses a goal net, that automatically generates sound effects when a goal is made, said method comprising the steps of:

providing a housing having at least one mounting hook extending therefrom, said housing retaining a power source, a sound generating device and a motion sensor that detects physical movement of said housing;

attaching said housing to said goal net, by engaging said at least one mounting hook with said goal net, whereby said housing moves with said goal net when said goal net is displaced during a goal;

detecting with said motion sensor when said goal net is displaced by a goal and activating said sound generating device for a predetermined amount of time after a goal is detected by said motion sensor.

2. The method according to claim 1, wherein said housing supports at least one light and wherein said method further including the step of activating said at least one light on said housing for a predetermined amount of time after a goal is detected by said motion sensor.

3. The method according to claim 1, wherein said goal net is a basketball net suspended from a hoop, and said step of attaching said housing to said a goal net includes attaching said sound generating device to said basketball net at least six inches below said hoop.

4. The method according to claim 1, wherein said motion sensor is an accelerometer that activates said noise generating device when a predetermined minimum change in acceleration is detected.

5. A method of providing sound effects to a basketball net when a basket is made, said method comprising the steps of:

providing a housing having at least one mounting hook extending therefrom, said housing retaining a power source, a sound generating device and a switch with an activation arm, wherein said activation arm extends from housing;

attaching said housing to said basketball net by engaging said at least one mounting hook with said basketball net, wherein said activation arm extends into said basketball net so that said activation arm is contacted by a basketball passing through said basketball net;

detecting with said activation arm when a basketball passes through said basketball net; and activating said sound generating device for a predetermined amount of time after a basketball is detected.

6. The method according to claim 5, wherein said housing supports at least one light and wherein said method further including the step of activating said at least one light on said housing for a predetermined amount of time after a goal is detected by said motion sensor.

7. The method according to claim 5, wherein said goal net is a basketball net suspended from a hoop, and said step of attaching said housing to said a goal net includes attaching said housing to said basketball net at least six inches below said hoop.

* * * * *